US005380237A

United States Patent [19]

Kenyon

[11] Patent Number: 5,380,237

[45] Date of Patent: Jan. 10, 1995

[54] SNOWMAN ACCESSORY KIT

[76] Inventor: Robert Kenyon, 1723 Jackson St., Scranton, Pa. 18504

[21] Appl. No.: 118,520

[22] Filed: Sep. 9, 1993

[51] Int. Cl.[6] ..... A63H 33/00

[52] U.S. Cl. ..... 446/491; 446/85; 446/97; 446/268

[58] Field of Search ..... 446/85, 27, 97, 268, 446/491, 98, 100, 99, 101

[56] References Cited

U.S. PATENT DOCUMENTS

| | | | |
|---|---|---|---|
| D. 312,114 | 11/1990 | Moore | D21/190 |
| D. 315,001 | 2/1991 | Bennett | D21/189 |
| 3,841,019 | 10/1974 | Lorenzo | 446/100 |
| 4,322,004 | 3/1982 | Schwuchow | 446/27 |

*Primary Examiner*—Robert A. Hafer
*Assistant Examiner*—Jeffrey D. Carlson
*Attorney, Agent, or Firm*—Michael I. Kroll

[57] ABSTRACT

An accessory kit is provided for a snowman having a head, an upper torso body and a lower torso body all made of packed snow, which consists of a set of decorative articles. A structure is for inserting each of the decorative articles into the packed snow of the head, the upper torso body and the lower torso body, to enhance the appearance of the snowman. Components are for retaining each of the inserting structures within the packed snow of the head, the upper torso body and the lower torso body of the snowman, so as to prevent the decorative articles from falling off of the snowman.

10 Claims, 1 Drawing Sheet

SNOWMAN ACCESSORY KIT

BACKGROUND OF THE INVENTION

NOTE: This invention has been assigned Ser. No. 285905, dated Jul. 3, 1991 under the Disclosure Document program.

Field of the Invention

The instant invention relates generally to winter outdoor activities and more specifically it relates to a snowman accessory kit.

Description of the Prior Art

Numerous winter outdoor activities have been provided in prior art that are adapted to include the construction of an artificial man of snow by adults and children. While these units may be suitable for the particular purpose to which they address, they would not be as suitable for the purposes of the present invention as heretofore described.

SUMMARY OF THE INVENTION

A primary object of the present invention is to provide a snowman accessory kit that will overcome the shortcomings of the prior art devices.

Another object is to provide a snowman accessory kit that is a set of articles which are simulated eyes, nose, mouth, buttons and pipe, placed onto a snowman made by adults and children.

An additional object is to provide a snowman accessory kit in which the substitute eyes, nose, mouth, buttons and pipe are structured so that once inserted into the snowman will be prevented from falling out of the packed snow.

A further object is to provide a snowman accessory kit that is simple and easy to use.

A still further object is to provide a snowman accessory kit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4, 5, 6, 7:
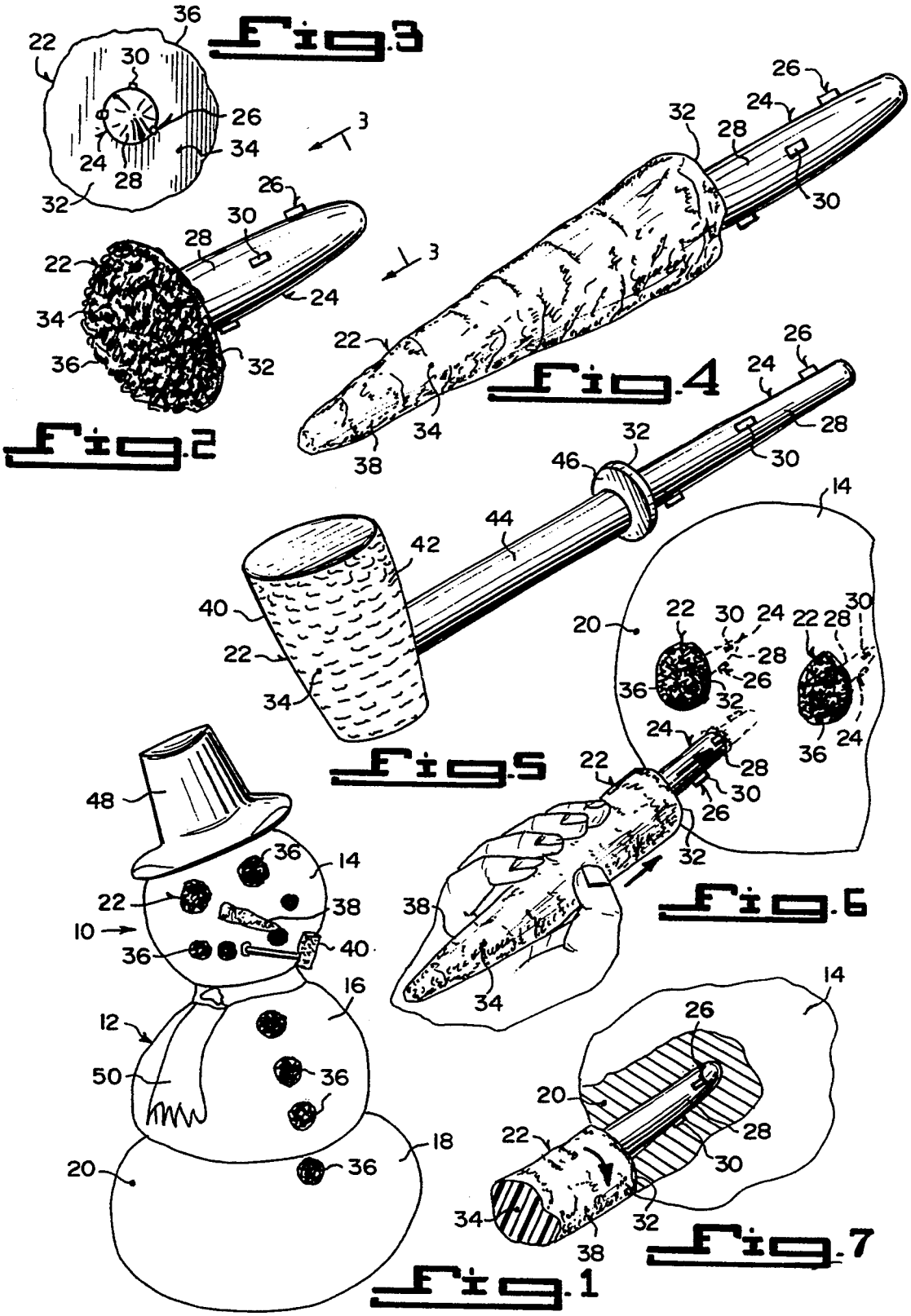
FIG. 1 is a perspective view of a snowman with the instant invention applied thereto.
FIG. 2 is a perspective view of one of the stick-in-pieces which represents the simulated eyes, mouth and buttons for the snowman.
FIG. 3 is a rear view taken in the direction of arrows 3—3 in FIG. 2.
FIG. 4 is a perspective view of one of the stick-in-pieces which represents the simulated nose of the snowman.
FIG. 5 is a perspective view of one of the stick-in-pieces which represents the corn cob pipe of the snowman.
FIG. 6 is a perspective view showing the simulated nose being inserted into the head of the snowman.
FIG. 7 is a perspective view with parts broken away and in section showing the simulated nose being rotated into the head of the snowman, so that it will not fall out.

Turning now descriptively to the drawings, in which similar reference characters denote similar elements throughout the several views, FIGS. 1 through 7 illustrate an accessory kit 10 for a snowman 12 having a head 14, an upper torso body 16 and a lower torso body 18, all made of packed snow 20, which consists of a set of decorative articles 22. A structure 24 is for inserting each of the decorative articles 22 into the packed snow 20 of the head 14, the upper torso body 16 and the lower torso body 18, to enhance the appearance of the snowman 12. Components 26 are for retaining each of the inserting structures 24 within the packed snow 20 of the head 14, the upper torso body 16 and the lower torso body 8, after insertion into the snowman 12, so as to prevent the decorative articles 22 from falling off of the snowman 12.

The inserting structure 24 for each of the decorative articles 22 is a stem 28, extending rearwardly thereof. The stem 28 is inserted into the packed snow 20.

The retaining components 26 for each of the decorative articles 22, are a plurality of nibs 30 radially positioned about the stem 28. When each stem 28 is inserted within the packed snow 20 and rotated, the nibs 30 will dig into the packed snow 20, to prevent the decorative article 22 from falling off.

Each decorative article 22 includes a rear stop surface 32, where the stem 28 extends rearwardly therefrom. When the stem 28 is inserted into the packed snow 20, the rear stop surface 32 will butt against the packed snow 20, to prevent further insertion. Each decorative article 22 with the respective stem 28 and the nibs 30 are integral and are fabricated out of plastic 34, which is injection molded.

Some of the decorative articles 22 are simulated coal pieces 36, used in making the eyes, mouth and buttons of the snowman 12. One of the decorative articles 22 is a simulated carrot 38, used in making the nose of the snowman 12. One of the decorative articles 22 is a simulated corn cob pipe 40, used in the mouth of the snowman 12. The simulated corn cob pipe 40 includes a bowl 42 and a shank 44, extending rearwardly from the bowl 42 to the stem 28. A flat rim 46 is affixed between the shank 44 and the stem 28 and has the rear stop surface 32 thereon.

OPERATION OF THE INVENTION

In assembling the snowman 12, the following steps should be taken:

1. Make the lower torso body 18 by rolling the packed snow 20 into a large ball.

2. Make the upper torso body 16 by rolling the packed snow 20 into a smaller ball.

3. Make the head 14 by rolling the packed snow 20 in an even smaller ball.

4. Assemble the upper torso body 16 onto the lower torso body 18.

5. Assemble the head 14 onto the upper torso body 16.

6. Insert the stems 28 of the decorative articles 22, which are the simulated coal pieces 36 for the eyes, mouth and buttons of the snowman 12 in a slightly downward position into the packed snow 20 of the head 14, the upper torso body 16 and the lower torso body 18.

7. Rotate each of the stems 28 a quarter turn, so that the nibs 30 will dig into the packed snow 20, to prevent the stems 28 from sliding out.

8. Insert the stem 28 of the decorative articles 22 which is the simulated carrot 38 for the nose of the snowman 12, also in a slightly downward position into the packed snow 20 in the head 14.

9. Rotate the stem 28 also a quarter turn, so that the nibs 30 will also dig into the packed snow 20, to prevent the stem 28 from sliding out.

10. Place a hat 48 onto the head 14 of the snowman 12.

11. Wrap a scarf 50 about the neck of the snowman 12, which is between the head 14 and the upper torso body 16.

12. The snowman 12 is now completed.

LIST OF REFERENCE NUMBERS 10 accessory kit
12 snowman
14 head of 12
16 upper torso body of 12
18 lower torso body of 12
20 packed snow of 12
22 decorative article
24 inserting structure on 22
26 retaining components on 24
28 stem for 24
30 nib of 26
32 rear stop surface on 22
34 plastic
36 simulated coal piece for 22
38 simulated carrot for 22
40 simulated corn cob pipe for 22
42 bowl of 40
44 shank of 40
46 flat ring with 32
48 hat
50 scarf It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. An accessory kit for a snowman having a head, an upper torso body and a lower torso body, all made of packed snow, which comprises:

a) a set of decorative articles having a circumference and a longitudinal axis;

b) means for inserting each of said decorative articles into the packed snow of the head, the upper torso body and the lower torso body, to enhance the appearance of the snowman; and c) retaining means on each of said articles having a plurality of appendages, each of said appendages being circumferentially spaced from every other appendage and each of said appendages further being longitudinally spaced from every other appendage whereby when an article is inserted into said snowman and turned, each of said appendages follows the same insertion path in a corkscrew-like manner, thus retaining said article in said snowman.

2. An accessory kit for a snowman as recited in claim 1, wherein said inserting means for each of said decorative articles includes a stem extending rearwardly thereof, whereby said stem is inserted into the packed snow.

3. An accessory kit for a snowman as recited in claim 2, wherein said retaining means for each of said decorative articles includes a plurality of nibs radially positioned about said stem, whereby when each said stem is inserted within the packed snow and rotated, said nibs will dig into the packed snow to prevent said decorative article from falling off.

4. An accessory kit for a snowman as recited in claim 3, wherein each said decorative article includes a rear stop surface where said stem extends rearwardly therefrom, so that when said stem is inserted into the packed snow, said rear stop surface will butt against the packed snow to prevent further insertion.

5. An accessory kit for a snowman as recited in claim 4, wherein each said decorative article with said respective stem and said nibs are integral and are fabricated out of plastic, which is injection molded.

6. An accessory kit for a snowman as recited in claim 5, wherein some of said decorative articles are simulated coal pieces used in making the eyes, mouth and buttons of the snowman.

7. An accessory kit for a snowman as recited in claim 6, wherein one of said decorative articles is a simulated carrot used in making the nose of the snowman.

8. An accessory kit for a snowman as recited in claim 7, wherein one of said decorative articles is a simulated corn cob pipe used in the mouth of the snowman.

9. An accessory kit for a snowman as recited in claim 8, wherein said simulated corn cob pipe includes:

a) a bowl; and b) a shank extending rearwardly from said bowl to said stem.

10. An accessory kit for a snowman as recited in claim 9, wherein said simulated corn cob pipe further includes a flat ring affixed between said shank and said stem having said rear stop surface thereon.

* * * * *